US007455175B2

(12) United States Patent
Cuomo

(10) Patent No.: US 7,455,175 B2
(45) Date of Patent: Nov. 25, 2008

(54) CARRIER AND METHOD

(75) Inventor: Angelo V. Cuomo, Staten Island, NY (US)

(73) Assignee: E-Z Media, Inc., New York, NY (US)

( * ) Notice: Subject to any disclaimer, the term of this patent is extended or adjusted under 35 U.S.C. 154(b) by 0 days.

(21) Appl. No.: 11/701,351

(22) Filed: Feb. 1, 2007

(65) Prior Publication Data

US 2008/0041735 A1 Feb. 21, 2008

Related U.S. Application Data

(63) Continuation-in-part of application No. 11/506,231, filed on Aug. 17, 2006.

(51) Int. Cl.
*B65D 75/00* (2006.01)
*B31B 11/00* (2006.01)

(52) U.S. Cl. ..... 206/175; 206/187; 206/193; 493/90

(58) Field of Classification Search ..... 206/142–144, 206/167, 170, 175, 180, 185, 187, 188, 190, 206/192, 193, 200, 427; 493/51, 90, 121, 493/128, 162
See application file for complete search history.

(56) References Cited

U.S. PATENT DOCUMENTS 2,011,232 A 8/1935 Parks
2,513,079 A 6/1950 Buerger
2,630,264 A 4/1953 Holy
3,158,286 A 11/1964 Phillips, Jr.
4,319,682 A * 3/1982 Wright et al. ..... 206/180
4,378,880 A 4/1983 Summers
4,610,349 A 9/1986 Schwartz et al.
4,767,051 A 8/1988 Single
4,770,294 A 9/1988 Graser
4,836,367 A 6/1989 Golkar
5,579,904 A * 12/1996 Holley, Jr. ..... 206/180
5,695,051 A 12/1997 Hart
5,709,298 A 1/1998 Harris
5,927,502 A 7/1999 Hunter
6,341,689 B1 1/2002 Jones
6,443,308 B1 9/2002 Davis
7,267,224 B2 * 9/2007 Cuomo ..... 206/175

* cited by examiner

*Primary Examiner*—Luan K Bui
(74) *Attorney, Agent, or Firm*—Kramer Levin Naftalis & Frankel LLP; Gregor N. Neff, Esq.

(57) ABSTRACT

In the blank for making the carrier, at least one foldable panel extending from one of the edges of the blank is provided. The panel is of a size and shape sufficient to cover the holes left by cut-outs from the vertical support panels to form dividers, when the panel is folded over onto one of the panels and secured thereto during assembly of the carrier from the blank.

7 Claims, 4 Drawing Sheets

CARRIER AND METHOD

This patent application is a continuation-in-part of U.S. patent application Ser. No. 11/506,231, filed Aug. 17, 2006.

This invention relates to carriers for carrying food, beverages in cups, bottles, and cans, and particularly to pre-packaged six-pack carriers.

In the manufacture of fiberboard carriers used in the past as pre-packaged six-pack carriers for bottled beverages, automated manufacturing equipment has been used. Some of such equipment includes straight-line gluing machines and right-angle gluing machines. Both types of equipment are in widespread use.

The straight-line gluers usually are capable of handling a longer carrier blank, which has tabs and flaps to be glued predominantly in a straight line along one edge of the blank.

Right-angle gluers often cannot accommodate as long a blank as the straight-line gluers. They typically apply glue in a first step with the blank moving through the gluer in one direction, and then the blank is rotated 90° and goes through the gluer in a direction perpendicular to the first direction.

Both types of equipment usually are relatively expensive and therefore should be used for as long as possible in order to amortize the purchase cost over the largest number of units of production possible, and thus maximize manufacturing profit.

Therefore, it is an object of the present invention to provide a set of blanks particularly adapted for use in right-angle gluers, in order to complement the provision of linear blanks for linear gluers, as shown in my above-identified U.S. patent application Ser. No. 11/012,440 filed Dec. 15, 2004, thereby providing a choice of different blanks to produce substantially the same carrier with almost equal facility on either type of equipment.

It is a further object of the invention to provide such a blank and a method of using it which is highly adaptable to the locations of glue heads and other configurations of existing right-angle gluers so as to minimize the changes required to manufacture the carriers of the invention and maximize the useful lifetime of such equipment.

It is another object of the invention to maximize the utilization of existing machinery, including both in-line and right-angle gluers, for each of a wide variety of manufactures so as to maximize the utility and profit for the manufactures of the carrier of the invention.

The foregoing objects are met by the provision of right-angle gluer blanks in which a plurality of flanges forming two separate receptacles secured to two vertical support panels are arranged in parallel rows on a blank, together with the vertical support panels. The flanges for the two receptacles, and other foldable parts of the carrier are glued in a first path through the gluing machine in a first direction. Then, the blank is rotated and sent through the gluer in a second direction perpendicular to the first direction to finish the gluing operation.

The carrier is folded at appropriate times in the process to insure that the glue-bearing surfaces adhere to the desired areas of the carrier panels when the folds are made.

In accordance with the invention, the manufacturer can select either in-line blanks or right-angle blanks to use on various pieces of equipment the manufacturer already owns. In addition, should the manufacturer need to acquire more equipment, the manufacturer can select among the various types of blanks and make an appropriate gluing machine purchase.

As a result, a high level of utilization of existing equipment, efficiency of manufacturing and relatively low cost are facilitated.

A further problem, found primarily in some pre-packaged beverage carriers, is that the dividers for separating the two beverage receptacles into compartments often are formed by cut-outs from the vertical support panels. These cut-outs leave sizable holes in the vertical support panels through which beverage bottles can contact other bottles in the other receptacle. Sometimes, the bottles will break due to such contact when the carrier is hit.

This problem is alleviated, in accordance with another feature of the invention, by providing in the carrier blank a flange or panel extending from one side of the blank and having a size and shape adequate to cover one or more such holes in at least one of the vertical support panels, when the panel is folded over during forming of the carrier from the blank.

If the two vertical support panels are to be fastened together back-to-back, only one such flange will cover all of the holes in both vertical panels.

If the vertical support panels are to be free to swing apart to display advertising on the inside surfaces, it is preferred to use two of the flanges, one for each vertical panel.

The foregoing and other objects and advantages of the invention will be set forth in or become apparent from the following description and drawings.

IN THE DRAWINGS

Figure 1:
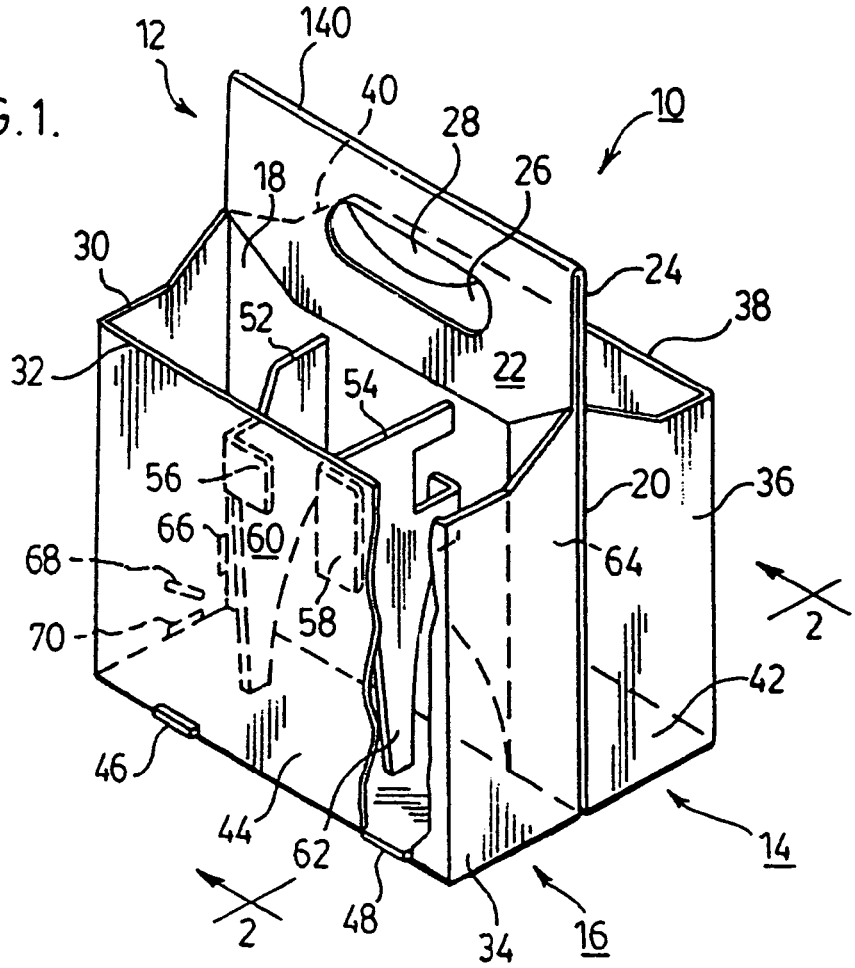
FIG. 1 is a partially broken-away perspective view of a carrier constructed in accordance with the present invention.
Figure 2:
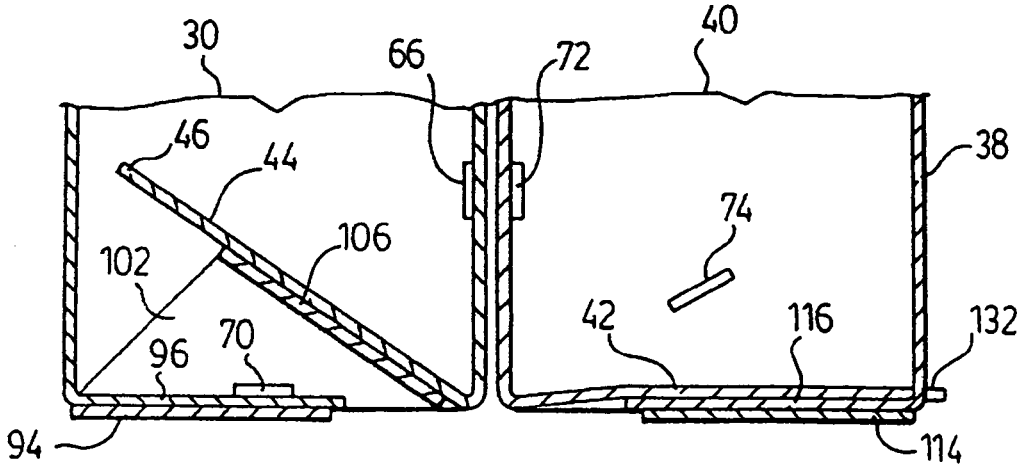
FIG. 2 is a cross-sectional broken-away view taken along line 2-2 of FIG. 1.
Figure 5:
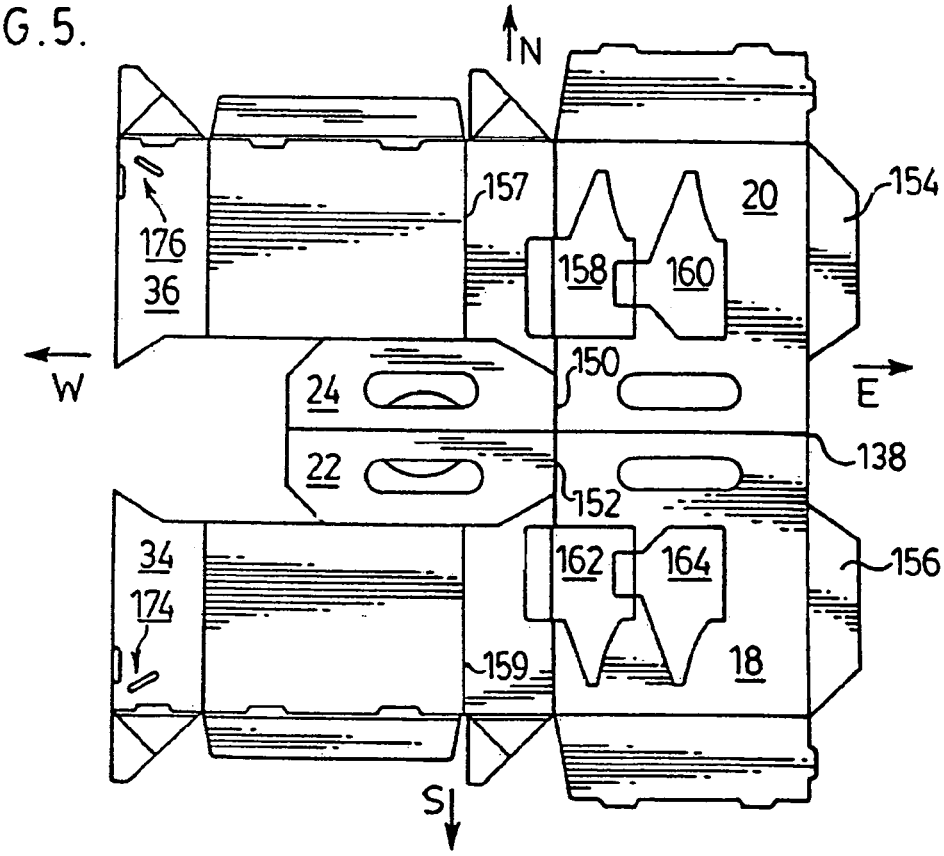
Figure 6:
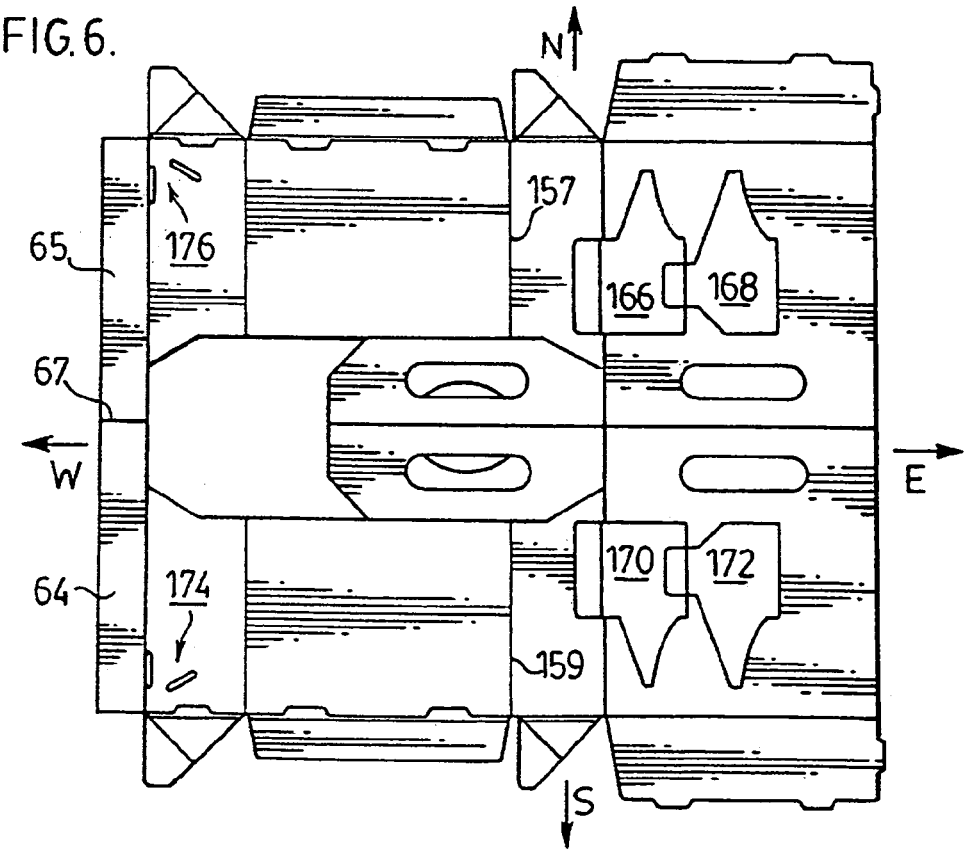
Figure 7:
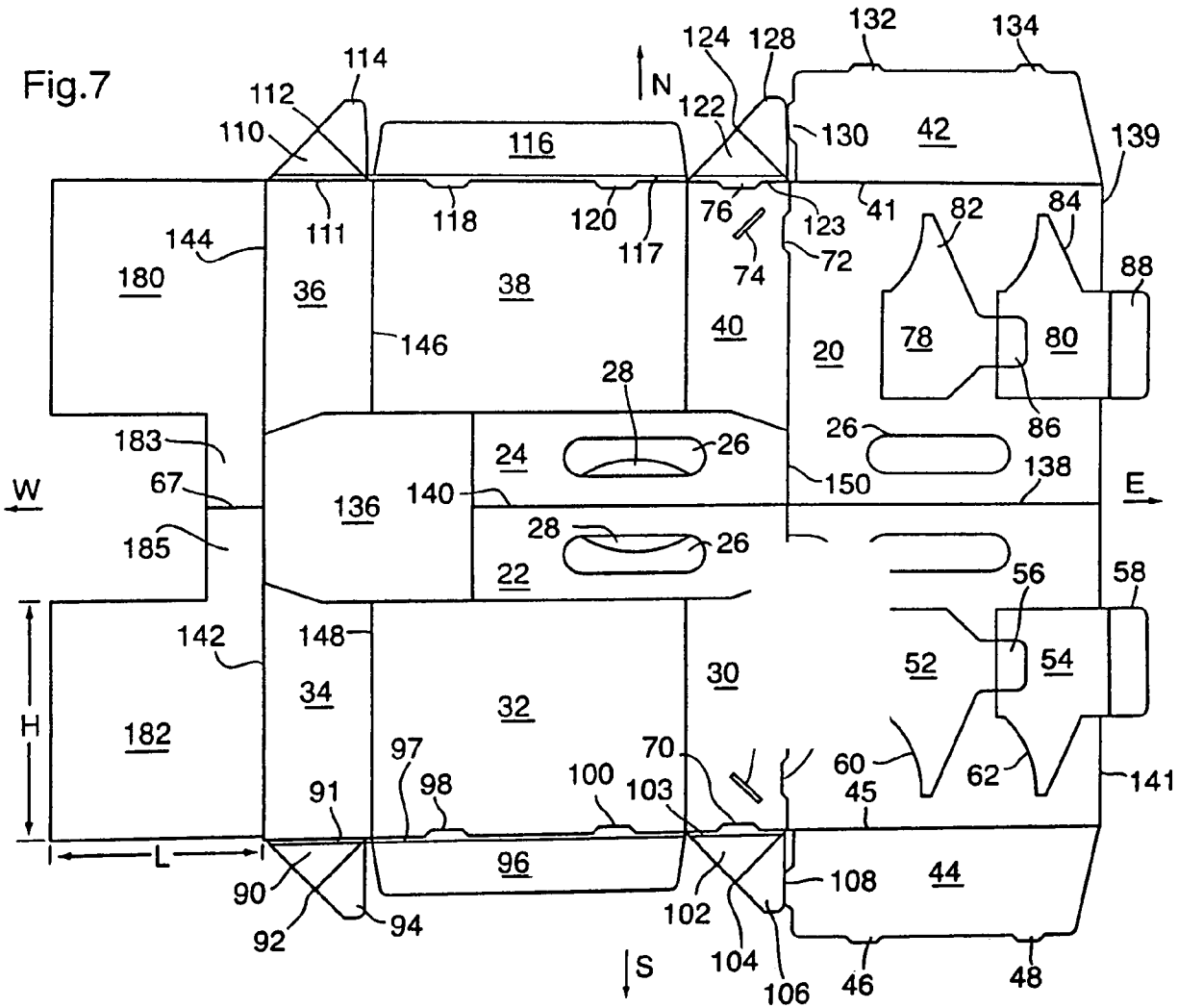

FIGS. 3, 4, 5, and 6 are top plan views of different blanks which can be used to manufacture the carrier shown in FIGS. 1 and 2 with right-angle gluers; and FIG. 7 is a top plan view of a blank for an improved carrier provided in accordance with the invention.

The carrier shown in FIGS. 1 and 2 is substantially the same as that shown in my above-identified U.S. patent applications, and particularly U.S. Ser. No. 10/929,264 filed Sep. 10, 2004, in FIGS. 48 and 55 of the drawings.

The carrier 10 shown in FIG. 1 includes a vertical support structure 12 including two back-to-back support panels 18 and 20, with reinforcement panels 22 and 24 glued onto their upper portions.

A hand-hole 26 with a hand guard 28 are provided in the reinforced upper region of the vertical support structure 12.

Two separate receptacles 14 and 16 are provided. One is secured to the support panel 18, and the other to the support panel 20.

Receptacle 16 includes relatively short side wall 30, a long side wall 32, and a short side wall 34. Similarly, receptacle 14 includes side walls 36, 38, and 40, with side walls 36 and 40 being relatively shorter than side wall 38.

A bottom wall structure is provided for each of the receptacles. The top panel of the bottom wall structure for receptacle 14 is panel 42, and the top panel for the bottom of the receptacle 16 is panel 44.

Figure 3:
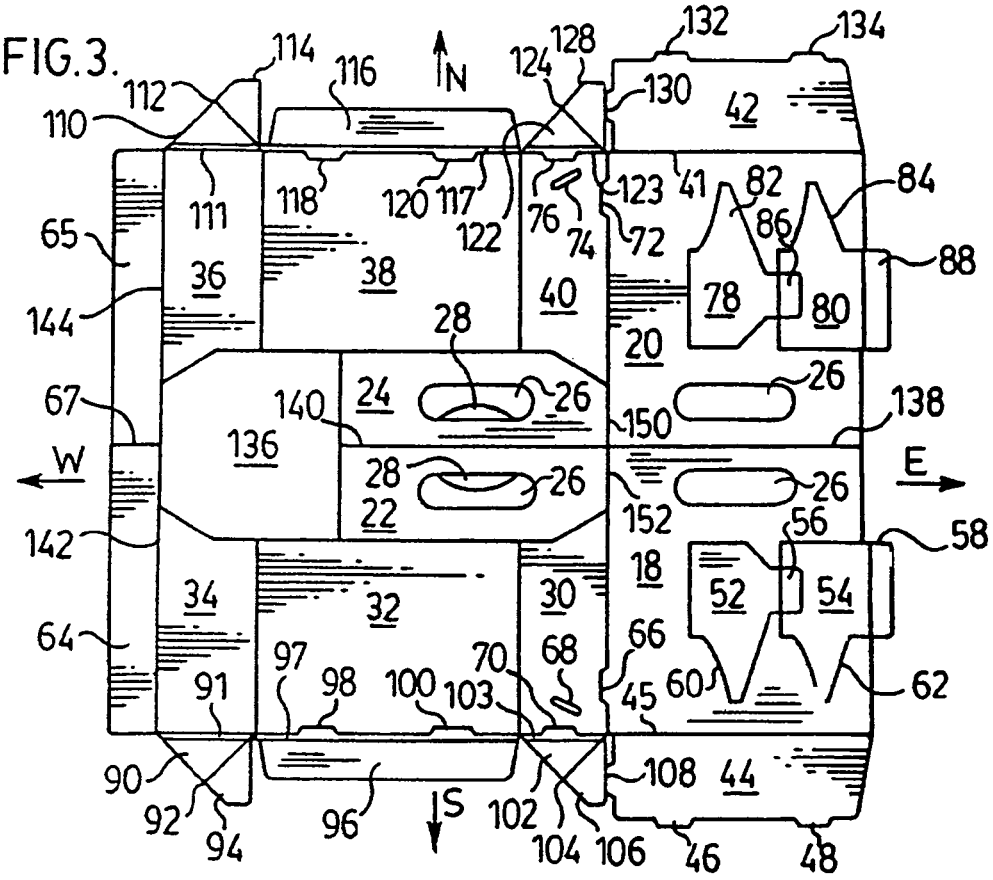

Each receptacle has a pair of dividers. The receptacle 16 has dividers 52 and 54, and receptacle 14 has dividers 78 and 80 (FIG. 3). The dividers for the receptacle 14 are not shown in FIG. 1 for the sake of clarity in the drawings.

Each of the four dividers has a glue tab 56 or 58 or 86 and 88 (FIG. 3) and a tapered, downwardly-extending lower portion 60 or 62, or 84 or 86 (FIG. 3). The glue tabs are glued to the inside of the long side wall 32 or 38 to hold them in place.

As it is described more fully in my above-identified prior patent applications, the top panel 42 or 44 in the bottom wall of each receptacle is a broad panel which spans the entire width of the bottom structure; that is, the width of the bottom structure from the panel 18 or 20 out to the long side wall 32 or 38 of each receptacle.

Preferably, each panel 42 or 44 engages with a narrow side wall 30 or 40 of one of the receptacles, as the carrier is being unfolded. Thus, the receptacle is held open so as to prevent it from relapsing into a folded condition.

Three slots are provided at 66, 68, and 70 in the wall 30, and at 72, 74, and 76 in the wall 40 (see FIG. 3). Also, a tab 108 or 130 extends from the side of the top bottom panel 44 or 42 (see FIG. 3). This tab rests in the vertical slot 66 or 72 when the carrier is folded up, and, as the carrier is unfolded, the tab slips into the slot 68 or 74, which is in an angular position such as that shown by the panel 44 in FIG. 2. In this position it remains until a bottle or other object placed in the carrier forces the panel 42 or 44 down completely. When it reaches the bottom position, the tab 108 or 130 slips into the slot 70 or 76 which extends horizontally. This helps to hold the panel 42 or 44 in place without shifting when the loaded carrier is moved about.

Also holding the panels 42 and 44 in place are tabs 46 and 48 and 132 and 134 which extend outwardly from the outer edges of the panels through slots 98, 100 or 118, 120.

As it is described in greater detail in my above-identified patent application Ser. No. 10/939,264, filed Sep. 10, 2004, the material forming the dividers 52, 54, 78, and 80 is cut out of the two vertical support panels 18 and 20, and, in some embodiments, a small amount of adjacent panels as well.

In the blank shown in FIG. 3, the glue tabs 56, 58, or 86, 88 of the dividers extend away from the main body of the divider in a direction towards the right in FIG. 3. For convenience, the blanks shown in FIGS. 3, 4, 5, and 6 will be designated with direction arrows indicating North, South, West and East as reference directions. Thus, the divider structures in FIG. 3 extend from West to East.

Advantageously, the glue tab ends 56 and 86 of the centrally-cut-out divider panels 52 and 78 extend into the material forming the other divider 54 or 80. Thus, the panels forming these dividers can be said to be "nested" within one another. This is highly advantageous and allows the provision of integral, one-piece foldout dividers which are difficult to provide within the size limitations dictated by the sizes of the normal beverage bottles to be carried. The tabs 58 and 88 can be seen to extend beyond the East edges 139, 141 of the support panels 18 and 20.

At the left or West end of the blank shown in FIG. 3 are provided two fairly wide glue flaps or flanges 64 and 65 joined along fold line 67. The flanges 64 and 65 are secured to the West edges of the panels 34, 36 along fold lines 142 and 144.

The flanges forming the two bottom structures for the receptacles 14 and 16 also are shown in FIG. 3. In the bottom structure for the receptacle 16, a flange extends downwardly from each of the three side walls 32, 34, and 30 as well as the vertical panel 18. Thus, flange 44 is secured to the bottom edge of the panel 18 along a fold line 45, and flange 42 is secured to the bottom edge of panel 20 along fold line 41.

Attached along the bottom edge of panel 34 along a fold line 91 is a triangular flange 90 with a truncated triangular glue tab 94, with the two being attached together along a fold line 92.

Similarly, attached along fold line 103 is a triangular flange 102 with a truncated triangular glue tab 106, attached to flange 102 along a fold line 104.

A relatively narrow but longer flange 96 is attached to the lower edge of side wall panel 32 along a fold line 97.

Similarly, a triangular flange 110 is connected along fold line 111 to the bottom edge of side wall panel 36, and a truncated triangular glue tab is joined to the flange 110 along a fold line 112.

Another triangular flange extends from the bottom edge of the side wall panel 40 along a fold line 123, and has a truncated triangular glue tab 128 secured to it along a fold line 124.

Finally, another relatively narrow but long flange 116 like flange 96 is secured to the bottom edge of panel 38 along a fold line 117.

The reinforcing panels 22 and 24 are secured at their East edges to the vertical panels 20 and 18, respectively, along fold lines 150 and 152. A fold line 140 between the two panels 22 and 24 is provided so as to form the upper edge of the handle structure when the carrier is assembled, as shown in FIG. 1.

The area 136 is open space. The reinforcement panels 22 and 24 are cut to be separate from the upper edges of panels 38, 40, 30, and 32.

In manufacturing a carrier from the blank shown in FIG. 3 using a right-angle gluer, the blank, after being die cut from a sheet, is fed into the gluer in a westerly direction; that is, from East to West. Prior to that, the flanges and other surfaces to be glued in the first step are folded over as necessary. Specifically, the flanges 44, 102, 96, and 90 are folded upwardly to the North, towards the horizontal center line 138 of the blank. The flanges 42, 122, 116, and 110 are folded towards the center line 138.

The flanges 64 and 65 are not folded at this time.

Then, the glue tabs 94, 106, 114, and 128 are folded along fold lines 92, 104, 112, or 124 towards the centerline 138 so that the under surface of each of the glue tabs is facing upwardly to receive glue.

Then, the blank is moved through the right-angle gluer from East to West, at which time properly pre-positioned glue heads apply adhesive to the proper areas, thus placing glue upon the tabs 86 and 88, 56 and 58 of the dividers; the tabs 106, 94, 114, 128 of the bottom structures, the flanges 64 and 65, and the reinforcement panels 22 and 24. Glue is not applied to the portions of the flanges 64, 65 that will contact the divider cut-outs later in a subsequent folding step.

Next, the blank is folded from East to West along fold lines 150 and 152. This causes the glue tabs 86, 88, 56, 58, 106 and 128, and panels 22 and 24 to adhere at the proper locations on the panels to which they are to be secured.

Next, the panels 34 and 36, with the flanges 64, 65 are folded from West to East along fold lines 146, 148, so that glue tabs 94, 114 adhere to panels 96 and 116, respectively, and flanges 64, 65 adhere to the panels 18 and 20 at the East edges 139 and 141, but do not adhere to the divider cut-outs.

Next, the blank shown in FIG. 3 is rotated 90° counterclockwise, and then is moved from North to South, that is, in a direction perpendicular to the original direction of movement, during which glue is applied to the panels 18 and 20. Then, the two halves of the blank are folded along the line 138 so that the two vertical panels are glued together back-to-back. The folded carrier now is complete and ready to pack and ship to a bottler or other user.

Figure 4:
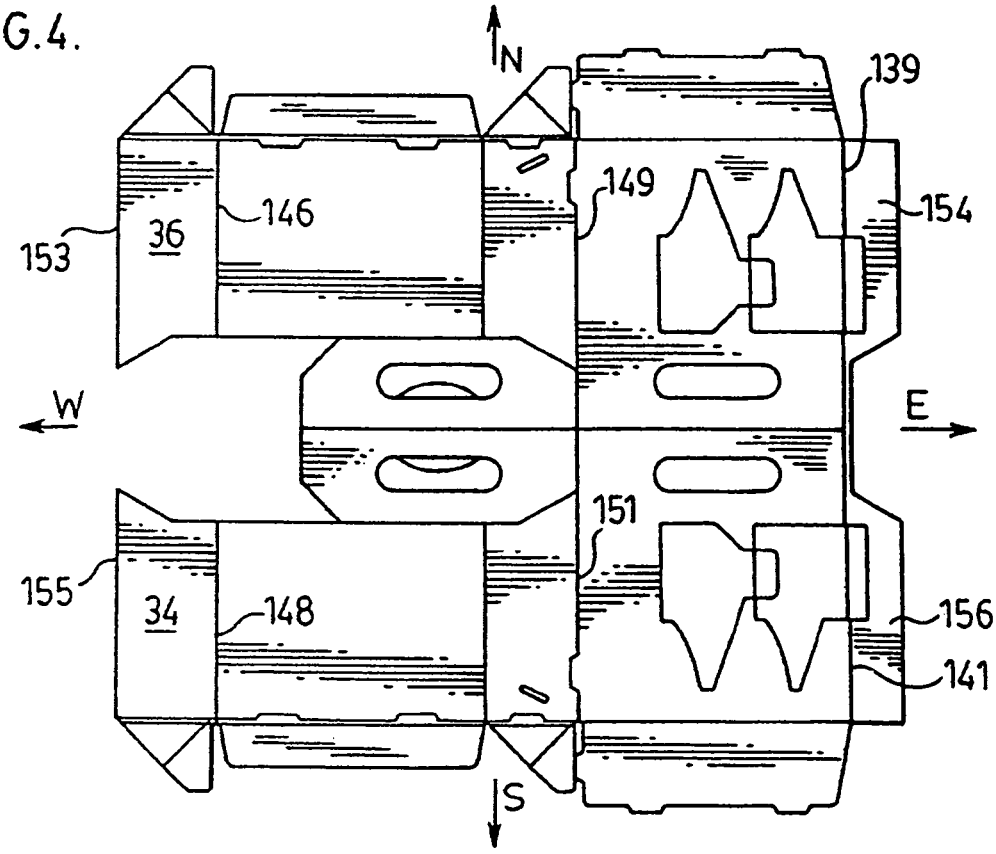

In accordance with the present invention, accommodation is made for a variety of different glue head configurations in right-angle gluers. For example, FIG. 4 shows the same blank as in FIG. 3, except that the flanges 64 and 65 on the West edge of the blank have been replaced by flanges 154 and 156 on the East edges of the blank. This accommodates the needs of gluers in which it is easiest to apply glue to the various locations where it is required by having the flanges at the East edge instead of the West edge.

The process of folding and gluing the FIG. 4 blank is the same as for the FIG. 3 blank, except that the flanges 154, 156 are not glued before the first fold along lines 149, 151. However, the backs of the flanges are glued after the first fold so that, after the second fold, along lines 146, 148, the flanges 154, 156 will adhere, respectively to the West edges 153, 155 of the panels 36 and 34.

FIGS. 5 and 6 show two additional embodiments of the blank structure. These blanks are the same as that shown in FIG. 3 except that the bottom flanges are reversed in direction, the slot groups 174 and 176 are changed in position, and the four divider cut-outs 158, 160, 162, and 164 point to the West instead of to the East. The flanges 154 and 156 are on the East edge of the blank, as in the FIG. 4 embodiment.

The folding and gluing of the FIG. 5 blank is different from those described above.

The flanges 154 and 156 are folded and glued in the first step in which the bottom flanges are folded and glued, and the divider glue tabs and reinforcement panels 24, 22 are glued.

In the first fold, the panels 18, 20, etc., are folded from East to West along lines 157,159, and the flanges 154, 156 adhere near the West edges of panels 36, 34, and the bottom and divider tabs are adhered to their target areas.

In the second fold, the reinforcement panels 22, 24 are folded from West to East along lines 150, 152 to adhere to the panels 18 and 20, respectively.

Then the blank is rotated and the panels 18, 20 are glued and folded together along line 138 to finish the carrier.

The FIG. 6 blank is the same as the FIG. 5 blank except that the flanges 64, 65 are folded and glued during the first step instead of the flanges 154 and 156.

The end flanges and panels are given different shapes, in some cases, in order to avoid covering parts which are not intended to be covered.

If it is not desired to secure the support panels 18, 20 back-to-back but to leave them hinged along line 138 so as to allow them to carry advertising and promotional matter on the surfaces, one merely omits the rotating step, the support panel gluing step, and if shipment of the carriers in partially-folded form is either desired or acceptable, the final fold step along line 138 also can be omitted.

It should be evident that various permutations and combinations of locations of parts can be selected, in accordance with the present invention, to facilitate the utilization of specific glue head orientations of existing equipment, to maximize the through-put through the machines, or for other beneficial manufacturing reasons. The flexibility of the blank structure permits making these changes.

FIG. 7 shows another carrier blank which is the same as that shown in FIG. 3, except that, in place of the relatively narrow glue flaps 64, 65 there are two wide panels 180, 182, each having a narrower portion 183 or 185, which has approximately the same width as one of the glue flaps 64, 65.

Each of the panels 180, 182 has a length L and a height H sufficient so that the panel will cover both of the openings in the vertical panel 18 or 20 when glue is applied to cause it to adhere to the areas of the panel 18 or 20 around the openings. When the panel 180 or 182 is folded along line 142 or 144 onto the inner surface of one of the vertical panels 18 or 20.

When the panels 180 and 182 are glued in place in this manner, the holes in the vertical panels are closed so that glass bottles in different receptacles will not clash against one another through the holes and possibly break. That is, the fiberboard of which the panels 180, 182 are made provides cushioning to absorb some of the force with which adjacent bottles might strike one another.

It is not necessary to use two panels 180 and 182 to achieve the desired cushioning if the vertical panels are to be glued together back-to-back. In that case, only one panel 180 or 182 will be sufficient to provide adequate cushioning.

When the vertical panels 18 and 20 are not glued together and left to swing apart to view advertising on the inside surfaces of the vertical panels 18 and 20, it is preferred to use both panels 180, 182 in order to maximize the surface area available on the back surfaces of those panels to display advertising or booklets, or CD's, etc.

If only one of the panels 180, 182 is used, the additional fiberboard used to provide the cushioning is reduced because the blanks can be nested together to occupy less area on a sheet of material.

The blank shown in FIG. 7 is glued and folded in the same way as that shown in FIG. 3 in order to form a completed carrier, folded flat.

The modifications of the FIG. 3 blank necessary to cover the divider cut-out holes can be extended to the blanks shown in FIGS. 4-6 in order to extend the benefits of this invention to those blanks as well. All that need be done is to use at least one side flange which is of a size and shape sufficient to cover the divider cut-out holes when it is folded over onto the inner surface of one of the vertical support panels 18, 20.

The above description of the invention is intended to be illustrative and not limiting. Various changes or modifications in the embodiments described may occur to those skilled in the art. These can be made without departing from the spirit or scope of the invention.

What is claimed is:

1. A blank for forming a foldable carrier, said blank comprising (a) a pair of support panels each having opposed side edges extending in a first direction, and first and second opposed transverse end edges extending in a second direction transverse to said first direction, said support panels being arranged with said side edges aligned with one another, and the first of said transverse end edges of each panel adjacent and parallel to the first of said transverse end edges of the other of said support panels, (b) a pair of side-wall structures for forming two receptacles, each secured to one of said support panels, (c) each of said side-wall structures comprising a plurality of side-wall panels joined together in series with one of said support panels along fold lines, (d) each of said side-wall panels and said support panels having a bottom flange extending outwardly from one edge, said flanges forming two linear groups of four bottom flanges extending outwardly from opposite sides of said blank, (e) at least two of said flanges in each of said groups having an attachment corner with a diagonal fold line, whereby said corner can be attached to an adjacent one of said flanges to form an automatically-opening bottom structure of one of said receptacles, (f) each of said support panels having at least one divider cut-out therefrom and forming a hole in said support panel, and (g) at least one end panel extending outwardly from one end of at least one of said linear groups, said one end panel having a size and shape to substantially cover said hole in said support panel when said one end panel is bent over one edge of said one linear group and secured to one surface of said support panel.

2. A blank as in claim 1 including a second one of said end panels for the other of said linear groups.

3. A blank as in claim 1 in which there are two of said cut-outs forming two dividers for each of said support panels, and leaving two holes in each of said support panels, each of said dividers being secured to said support panel along a longitudinal fold line, said cut-outs extending in said transverse direction, said end panel having a size and shape sufficient to cover both of said holes.

4. A method of making a foldable carrier, comprising the steps of:

(a) providing a blank having (i) a pair of support panels each having opposed side edges extending in a first direction, and first and second opposed transverse end edges, said support panels being arranged with said side edges aligned with one another and the first of said end edges of each panel adjacent and parallel to the first of said transverse end edges of the other of said support panels, (ii) a pair of side-wall structures for forming two receptacles, each secured to one of said support panels, (iii) each of said side-wall structures comprising a plurality of side-wall panels joined together in series with one of said support panels along fold lines, (iv) each of said side-wall panels and said support panels having a bottom flange extending outwardly from one edge, said flanges forming two linear groups of four bottom flanges extending outwardly from opposite sides of said blank, at least two of said flanges in each of said groups each having an attachment corner with a diagonal fold line, whereby said corner can be attached to an adjacent one of said flanges to form an automatically-opening bottom structure of one of said receptacles, (v) each of said support panels having at least one hole formed by a divider cut-out, (vi) a pair of side flanges, each extending from one side of said blank and positioned to fasten one of said side walls and one of said support panels together in each of said groups to form enclosures for each of said receptacles, at least one of said side flanges being of a size and shape sufficient to cover at least one of said holes when folded over, (b) folding over said flanges and attachment corners to be glued, and moving said blank in a first direction through a gluer to apply glue to said corners and flanges, and (c) folding said blank along at least one pre-determined longitudinal fold line to adhere said attachment corners and flanges to desired attachment surfaces of said blank.

5. A method as in claim 4 including the further step of (d) rotating said blank by about 90°, (e) moving said blank in a second direction orthogonal to said first direction and applying adhesive to at least one of said support panels, and (f) folding said support panels one on top of the other to adhere said support panels together.

6. A carrier blank comprising:

(a) a pair of vertical support panels, (b) two groups of side-wall panels, each connected in series to one of said support panels so as to form, when assembled together with said support panels, a walled enclosure for a receptacle, (c) a plurality of bottom flanges, one extending from the lower edge of each of said side wall panels and the attached support panel in each of said groups, said flanges adapted to be selectively secured to one another to form an automatically-opening bottom wall for one of said receptacles, and (d) at least one cut-out from the material of each of said support panels forming at least one divider for each of said receptacles, said cut-out forming a hole in the support panel from which it is cut, and (e) at least one side flange extending from one end of one of said groups of side wall panels and having a size and shape to substantially cover said hole when folded over on to one side of said one support panel in assembling a carrier from said blank.

7. A blank as in claim 6 in which there are at least two divider cut-outs forming at least two holes in each of said support panels, and said one side flange being of a size and shape sufficient to cover both holes.

* * * * *